US005214993A

United States Patent [19]

Konishi

[11] Patent Number: 5,214,993

[45] Date of Patent: Jun. 1, 1993

[54] AUTOMATIC DUET TONES GENERATION APPARATUS IN AN ELECTRONIC MUSICAL INSTRUMENT

[75] Inventor: Shinya Konishi, Hamamatsu, Japan

[73] Assignee: Kabushiki Kaisha Kawai Gakki Seisakusho, Shizuoka, Japan

[21] Appl. No.: 845,956

[22] Filed: Mar. 4, 1992

[30] Foreign Application Priority Data

Mar. 6, 1991 [JP] Japan ..... 3-65683

[51] Int. Cl.[5] ..... G10H 1/38; G10H 1/40

[52] U.S. Cl. ..... 84/637; 84/613; 84/631; 84/DIG. 4; 84/DIG. 22

[58] Field of Search ..... 84/637, 631, 650, 664, 84/669, DIG. 4, DIG. 22, 613

[56] References Cited

U.S. PATENT DOCUMENTS

| | | | |
|---|---|---|---|
| 4,429,606 | 2/1984 | Aoki . | |
| 4,864,907 | 9/1989 | Oguri | 84/637 |
| 4,905,561 | 3/1990 | Mizuno | 84/DIG. 22 |
| 4,926,737 | 5/1990 | Minamitaka | 84/DIG. 22 |
| 5,056,401 | 10/1991 | Yamaguchi et al. | 84/637 |
| 5,153,361 | 10/1992 | Kozuki | 84/637 |

*Primary Examiner*—William M. Shoop, Jr.
*Assistant Examiner*—Helen Kim

[57] ABSTRACT

In an electronic musical instrument for automatically a adding duet note, an apparatus, which can reduce the capacity of a memory for storing data used as a basis for selecting a duet note to be added, is disclosed. A chord depressed at a keyboard is specified by a chord specifying means, and a depressed melody note (highest note) is detected by a note detection device. According to these notes, duet note data, which can be added, is read out from a chord-notes weighting information storage area on the basis of chord constituting notes, and another duet note data, which can be added, is read out from a note weighting information storage area according to a relative note data of the highest note relative to the root note of the chord. These readout duet note data are subjected to a calculation, thus selecting a duet note. Therefore, duet note data corresponding in numbers to chords and relative notes need only be stored in the memory, thus reducing the capacity of the duet note data memory.

25 Claims, 17 Drawing Sheets

FIG. 3

| | |
|---|---|
| C<br>100010010000 | Cm<br>100100010000 |
| C7<br>100010010010 | Cm7<br>100100010010 |
| Cmaj7<br>100010010001 | Cmmaj7<br>100100010001 |
| Caug<br>100010001000 | Cm7-5<br>100100100010 |
| Cdim<br>100100100100 | C7sus4<br>100001010000 |
| C6<br>100010010100 | Cm6<br>100100010100 |
| Cadd9<br>101010010000 | Cmadd9<br>101100010000 |
| C13<br>100010000110 | Cb13<br>100010001010 |

FIG. 4

| | |
|---|---|
| C<br>1 1 1 1 1 1 1 1 1 1 1 1 | Cm<br>1 1 1 1 1 1 1 1 1 1 1 1 |
| C7<br>1 1 1 1 1 1 1 1 1 1 1 1 | Cm7<br>1 1 1 1 1 1 1 1 1 1 1 1 |
| Cmaj7<br>1 1 1 1 1 1 1 1 1 1 1 0 | Cmmaj7<br>1 1 1 1 1 1 1 1 1 1 1 1 |
| Caug<br>1 1 1 1 1 1 1 1 1 1 1 1 | Cm7-5<br>1 1 1 1 1 1 1 1 1 1 1 1 |
| Cdim<br>1 1 1 0 1 1 1 1 1 1 1 1 | C7sus4<br>1 1 1 1 1 1 1 1 1 1 1 1 |
| C6<br>1 1 1 1 1 1 1 1 1 0 1 1 | Cm6<br>1 1 1 1 1 1 1 1 1 0 1 1 |
| Cadd9<br>1 1 1 1 1 1 1 1 1 1 1 1 | Cmadd9<br>1 1 0 1 1 1 1 1 1 1 1 1 |
| C13<br>1 1 1 1 1 1 1 1 1 0 1 1 | Cb13<br>1 1 1 1 1 1 1 1 1 1 1 1 |

FIG. 5

| | |
|---|---|
| C<br>002000000000 | Cm<br>000000000000 |
| C7<br>002000020000 | Cm7<br>000000020000 |
| Cmaj7<br>002000000000 | Cmmaj7<br>000000000000 |
| Caug<br>002000000000 | Cm7-5<br>000000000000 |
| Cdim<br>000000000000 | C7sus4<br>000000000020 |
| C6<br>002000000000 | Cm6<br>000000000000 |
| Cadd9<br>000000000000 | Cmadd9<br>000000000000 |
| C13<br>002000000000 | Cb13<br>000000000000 |

FIG. 6

| | |
|---|---|
| C<br>102010010000 | Cm<br>100100010000 |
| C7<br>102010020010 | Cm7<br>100100020010 |
| Cmaj7<br>102010010000 | Cmmaj7<br>100100010001 |
| Caug<br>102010001000 | Cm7-5<br>100100100010 |
| Cdim<br>100000100100 | C7sus4<br>100001010020 |
| C6<br>102010010000 | Cm6<br>100100010000 |
| Cadd9<br>101010010000 | Cmadd9<br>100100010000 |
| C13<br>102010000010 | Cb13<br>100010001010 |

FIG. 7

| | |
|---|---|
| C<br>000000010000 | Cm<br>100000000000 |
| C7<br>000000010000 | Cm7<br>100000000000 |
| Cmaj7<br>000000010000 | Cmmaj7<br>100000000000 |
| Caug<br>111111111111 | Cm7-5<br>111111111111 |
| Cdim<br>111111111111 | C7sus4<br>111111111111 |
| C6<br>000000010000 | Cm6<br>100000000000 |
| Cadd9<br>000000010000 | Cmadd9<br>100000000000 |
| C13<br>111111111111 | Cb13<br>111111111111 |

FIG. 8

| | |
|---|---|
| C | 000110010100 |
| C# | 000010110100 |
| D | 000000011111 |
| D# | 100000011011 |
| E | 100000000000 |
| F | 101000000000 |
| F# | 101100000000 |
| G | 100110000000 |
| G# | 101111000000 |
| A | 100111100000 |
| A# | 101111100000 |
| B | 100111100000 |

FIG. 9

| | |
|---|---|
| C | 000110000000 |
| C# | 000000010100 |
| D | 000000000011 |
| D# | 000000001010 |
| E | 000000000000 |
| F | 001000000000 |
| F# | 001100000000 |
| G | 000110000000 |
| G# | 000111000000 |
| A | 000111100000 |
| A# | 000111100000 |
| B | 000110100000 |

FIG. 10

| | C | Cm | C7 | Cm7 |
|---|---|---|---|---|
| | 102010010000 | 100100010000 | 102010020010 | 100100020010 |
| C | 000220010100<br>E G | 000220010100<br>Eb G | 000220010100<br>E G | 000220010100<br>Eb G |
| C# | 000010120200<br>E G | 000010120200<br>G | 000010120200<br>E G | 000010120200<br>G |
| D | 000000011122<br>G | 000000011122<br>G | 000000011122<br>G Bb | 000000011122<br>G Bb |
| D# | 100000012021<br>C G | 100000012021<br>C G | 100000012021<br>C G | 100000012021<br>C G |
| E | 100000000000<br>C | 100000000000<br>C | 100000000000<br>C | 100000000000<br>C |
| F | 102000000000<br>C D | 102000000000<br>C | 102000000000<br>C D | 102000000000<br>C |
| F# | 102200000000<br>C D | 102200000000<br>C Eb | 102200000000<br>C D | 102200000000<br>C Eb |
| G | 100220000000<br>C E | 100220000000<br>C Eb | 100220000000<br>C E | 100220000000<br>C Eb |
| G# | 101222000000<br>C D E | 101222000000<br>C Eb | 101222000000<br>C D E | 101222000000<br>C Eb |
| A | 100222200000<br>C E | 100222200000<br>C Eb | 100222200000<br>C E | 100222200000<br>C Eb |
| A# | 101222200000<br>C D E | 101222200000<br>C Eb | 101222200000<br>C D E | 101222200000<br>C Eb |
| B | 100222200000<br>C E | 100222200000<br>C Eb | 100222200000<br>C E | 100222200000<br>C Eb |

FIG. 11

| | Cmaj7 | Cmmaj7 | Caug | Cm7-5 |
|---|---|---|---|---|
| | 102010010001 | 100100010001 | 102010001000 | 100100100010 |
| C | 000220010100 | 000220010100 | 000220010100 | 000220010100 |
| | E G | Eb G | E | Eb |
| C# | 000010120200 | 000010120200 | 000010120200 | 000010120200 |
| | E G | G | E | Gb |
| D | 000000011122 | 000000011122 | 000000011122 | 000000011122 |
| | G B | G B | G# | Bb |
| D# | 100000012021 | 100000012021 | 100000012021 | 100000012021 |
| | C G B | C G B | C G# | C G |
| E | 100000000000 | 100000000000 | 100000000000 | 100000000000 |
| | C | C | C | C |
| F | 102000000000 | 102000000000 | 102000000000 | 102000000000 |
| | C D | C | C D | C |
| F# | 102200000000 | 102200000000 | 102200000000 | 102200000000 |
| | C D | C Eb | C D | C Eb |
| G | 100220000000 | 100220000000 | 100220000000 | 100220000000 |
| | C E | C Eb | C E | C Eb |
| G# | 101222000000 | 101222000000 | 101222000000 | 101222000000 |
| | C D E | C Eb | C D E | C Eb |
| A | 100222200000 | 100222200000 | 100222200000 | 100222200000 |
| | C E | C Eb | C E | C Eb Gb |
| A# | 101222200000 | 101222200000 | 101222200000 | 101222200000 |
| | C D E | C Eb | C D E | C Eb Gb |
| B | 100222200000 | 100222200000 | 100222200000 | 100222200000 |
| | C E | C Eb | C E | C Eb Gb |

FIG. 12

| | Cdim | C7sus4 | C6 | Cm6 |
|---|---|---|---|---|
| | 100100100100 | 100001010020 | 102010010100 | 100100010100 |
| C | 000220010100 | 000220010100 | 000220010100 | 000220010100 |
| | Eb A | G | E G | Eb G |
| C# | 000010120200 | 000010120200 | 000010120200 | 000010120200 |
| | Gb A | G | E G | G A |
| D | 000000011122 | 000000011122 | 000000011122 | 000000011122 |
| | A | G Bb | G | G A |
| D# | 100000012021 | 100000012021 | 100000012021 | 100000012021 |
| | C | C G Bb | C G | C G |
| E | 100000000000 | 100000000000 | 100000000000 | 100000000000 |
| | C | C | C | C |
| F | 102000000000 | 102000000000 | 102000000000 | 102000000000 |
| | C | C | C D | C |
| F# | 102200000000 | 102200000000 | 102200000000 | 102200000000 |
| | C Eb | C | C D | C Eb |
| G | 100220000000 | 100220000000 | 100220000000 | 100220000000 |
| | C Eb | C | C E | C Eb |
| G# | 101222000000 | 101222000000 | 101222000000 | 101222000000 |
| | C Eb | C F | C D E | C Eb |
| A | 100222200000 | 100222200000 | 100222200000 | 100222200000 |
| | C Eb Gb | C F | C E | C Eb |
| A# | 101222200000 | 101222200000 | 101222200000 | 101222200000 |
| | C Eb Gb | C F | C D E | C Eb |
| B | 100222200000 | 100222200000 | 100222200000 | 100222200000 |
| | C Eb Gb | C F | C E | C Eb |

FIG. 13

| | Cadd9 | Cmadd9 | C13 | Cb13 |
|---|---|---|---|---|
| | 101010010000 | 101100010000 | 102010000110 | 100010001010 |
| C | 000220010100<br>E G | 000220010100<br>Eb G | 000220010100<br>E A | 000220010100<br>E |
| C# | 000010120200<br>E G | 000010120200<br>G | 000010120200<br>E A | 000010120200<br>E |
| D | 000000011122<br>G | 000000011122<br>G | 000000011122<br>E ABb | 000000011122<br>E G# Bb |
| D# | 100000012021<br>C G | 100000012021<br>C G | 100000012021<br>C | 100000012021<br>C G# |
| E | 100000000000<br>C | 100000000000<br>C | 100000000000<br>C | 100000000000<br>C |
| F | 102000000000<br>C D | 102000000000<br>C D | 102000000000<br>C | 102000000000<br>C |
| F# | 102200000000<br>C D | 102200000000<br>C DEb | 102200000000<br>C | 102200000000<br>C |
| G | 100220000000<br>C E | 100220000000<br>C Eb | 100220000000<br>C E | 100220000000<br>C E |
| G# | 101222000000<br>C D E | 101222000000<br>C DEb | 101222000000<br>C E | 101222000000<br>C E |
| A | 100222200000<br>C E | 100222200000<br>C Eb | 100222200000<br>C E | 100222200000<br>C E |
| A# | 101222200000<br>C D E | 101222200000<br>C DEb | 101222200000<br>C E | 101222200000<br>C E |
| B | 100222200000<br>C E | 100222200000<br>C Eb | 100222200000<br>C E | 100222200000<br>C E |

FIG. 14

| | C | Cm | C7 | Cm7 | C maj7 | Cm maj7 | Caug | Cm 7−5 | Cdim | C7 sus4 | C6 | Cm6 | C add9 | Cm add9 | C13 | Cb13 |
|---|---|---|---|---|---|---|---|---|---|---|---|---|---|---|---|---|
| C | E | Eb | E | Eb | E | Eb | E | Eb | A | G | E | Eb | E | Eb | E | E |
| C# | G | G | G | G | G | G | E | Gb | A | G | G | G | G | G | E | E |
| D | G | G | Bb | Bb | G | B | G# | Bb | A | Bb | G | G | G | G | Bb | Bb |
| D# | G | C | G | C | G | C | G# | C | C | Bb | G | C | G | C | C | C |
| E | C | C | C | C | C | C | C | C | C | C | C | C | C | C | C | C |
| F | D | C | D | C | D | C | D | C | C | C | D | C | D | C | C | C |
| F# | D | Eb | D | Eb | D | Eb | D | Eb | C | C | D | Eb | D | Eb | C | C |
| G | E | Eb | E | Eb | E | Eb | E | Eb | C | C | E | Eb | E | Eb | E | E |
| G# | E | Eb | E | Eb | E | Eb | E | Eb | C | F | E | Eb | E | Eb | E | E |
| A | E | Eb | E | Eb | E | Eb | E | Eb | Gb | F | E | Eb | E | Eb | E | E |
| A# | E | Eb | E | Eb | E | Eb | E | Eb | Gb | F | E | Eb | E | Eb | E | E |
| B | E | Eb | E | Eb | E | Eb | E | Eb | Gb | F | E | Eb | E | Eb | E | E |

A
118
DUET FLAG ON?
YES
NO
CONVERT KEY DATA
119
DEVELOP DUET NOTES BY RELATIVE NOTE
120
DEVELOP DUET NOTES BY CHORD-NOTES
121
DETERMINE DUET NOTES BY CHORD AND RELATIVE NOTE
122
SELECT A NOTE FROM DEVELOPABLE DUET NOTES
123
124
DATA=0?
YES
NO
125
USE DUET NOTE DATA IN STEP 122
126
D#?
YES
NO
127
DETERMINE DUET NOTE BY WEIGHTING INFORMATION OF D#
C
B

AUTOMATIC DUET TONES GENERATION APPARATUS IN AN ELECTRONIC MUSICAL INSTRUMENT

BACKGROUND OF THE INVENTION

1. FIELD OF THE INVENTION

The present invention relates to an electronic musical instrument comprising a keyboard.

2. DESCRIPTION OF THE BACKGROUND

In some electronic musical instruments having keyboards, a duet tone (ensemble tone) is generated in correspondence with a specific melody tone played at a keyboard, and is added to the melody tone, thus performing an auto-play operation.

A conventional electronic musical instrument, which automatically adds a duet tone to a melody tone played at a keyboard, discriminates the tonality, flow, and the like of a music piece to be played, and faithfully adds a duet tone according to the music theory. In this duet tone generation method, however, a player must designate a tonality in advance, and a play error cannot be coped with.

As an improved electronic musical instrument, with which a beginner can easily enjoy a duet tone play operation, which adds a duet tone as follows, is known. More specifically, the type of chord and the root note of the chord are detected in advance on the basis of a depressed key. When a player plays a melody, depressed keys of the melody tones are detected, and an interval between each detected melody tone and the root note of the chord, i.e., an interval of each melody tone with respect to the root is obtained as semitone count data, and difference data of a duet tone to be added is obtained from a table according to the semitone count data obtained in this manner, i.e., relative note data R·N, and the type of chord. More specifically, difference data representing an interval (difference) between a duet tone to be added and a melody tone as semitone count data are stored beforehand in a table according to an interval (relative note data R·N) of a melody tone with respect to a root note in units of types of chords such as major chords, minor chords, seventh chords, and the like, and the difference data of a duet tone is obtained from the table according to the detected chord and the relative note data R·N. The pitch of the duet tone to be added is determined on the basis of the obtained difference data, and the root note of the chord, thus generating the duet tone.

According to this apparatus, when a player plays a melody, a duet tone can be added on the basis of the difference data read out from the table, thus easily obtaining the duet tone. However, since the difference data of duet tones are stored according to the types of chords and relative note data R·N, a development table for storing difference data of duet tones corresponding in number to the product of the number of chords and the number of relative note data R·N is required. As a result, the capacity of the memory for storing data for obtaining a duet tone to be added is undesirably increased.

SUMMARY OF THE INVENTION

It is an object of the present invention to provide an electronic musical instrument for automatically adding a duet tone (ensemble tone), which can reduce the capacity of a memory for storing data for obtaining a duet tone to be added according to a chord and relative note data R·N.

An electronic musical instrument according to the present invention comprises a chord specifying means for specifying a chord on the basis of keys depressed at a keyboard. The instrument also comprises a note detection means for detecting, based on key information of a key depressed at the keyboard, a note to which a duet note (ensemble note) is to be added. When a plurality of keys are depressed, the note detection means detects a highest note (or lowest note) since a duet note is to be added to the highest note (or lowest note) of the plurality of tones. A chord-notes weighting information storage means stores data of first notes possible to be added as duet notes, the first notes being weighted in association with chord-notes and types of chords. A note weighting information storage means stores data of second notes possible to be added as duet notes, the second notes being weighted in association with relative notes, relative to root notes of chords and types of chords.

When addition of a duet note is instructed, data of notes one of which can be added as a duet note is read out from the chord-notes weighting information storage means programmed on the basis of the chord-notes, in response to the chord specified by the chord specifying means. In addition, data of notes one of which can be added as a duet note, is read out from the note weighting information storage means in response to the chord specified by the chord specifying means, and the note detected by the note detection means. These read-out data are subjected to a calculation to determine duet note data to be added. A tone corresponding to the duet note data formed by a duet note data generation means, and a tone played at the keyboard are generated by a tone forming means.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 15:
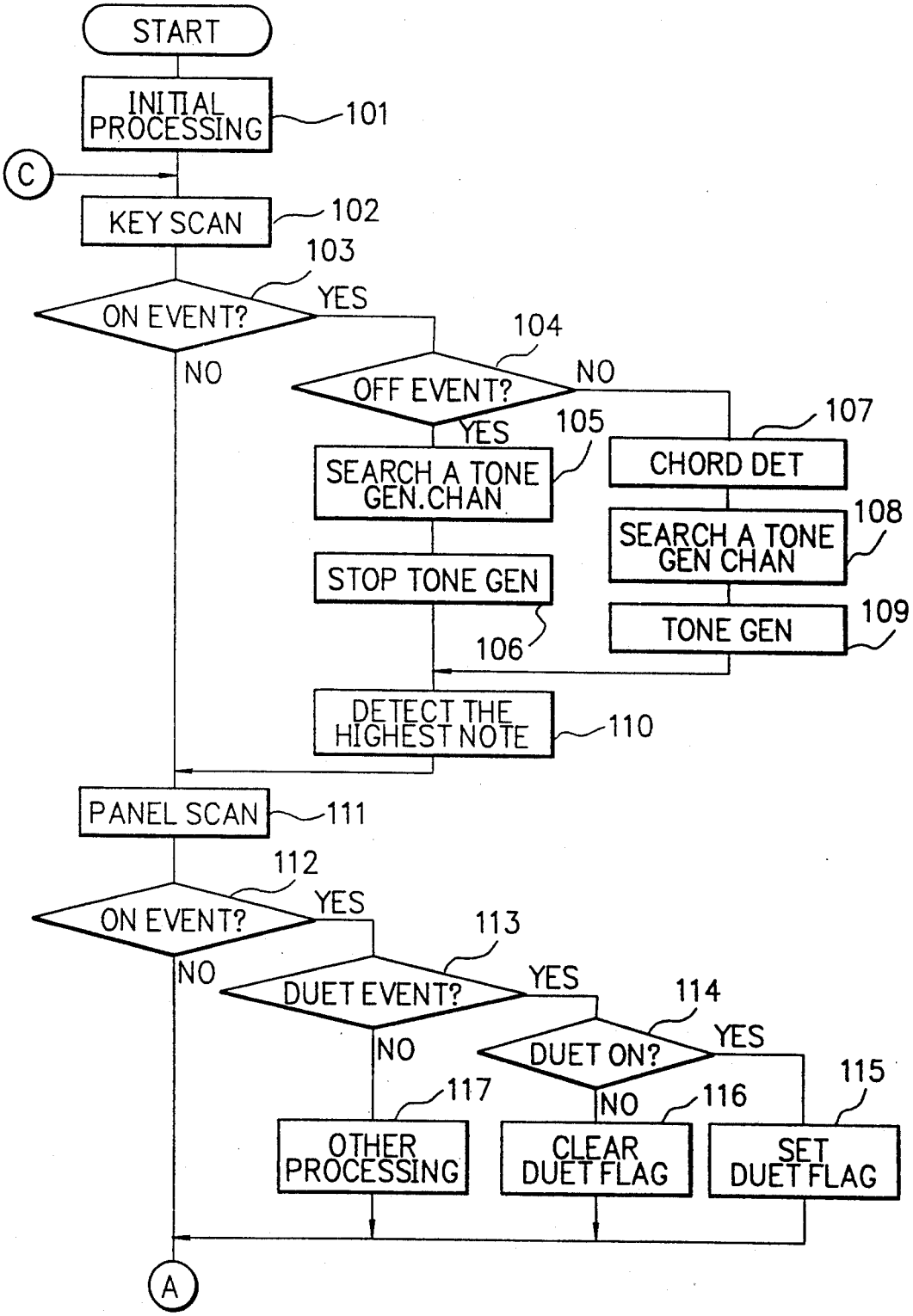
Figure 16:
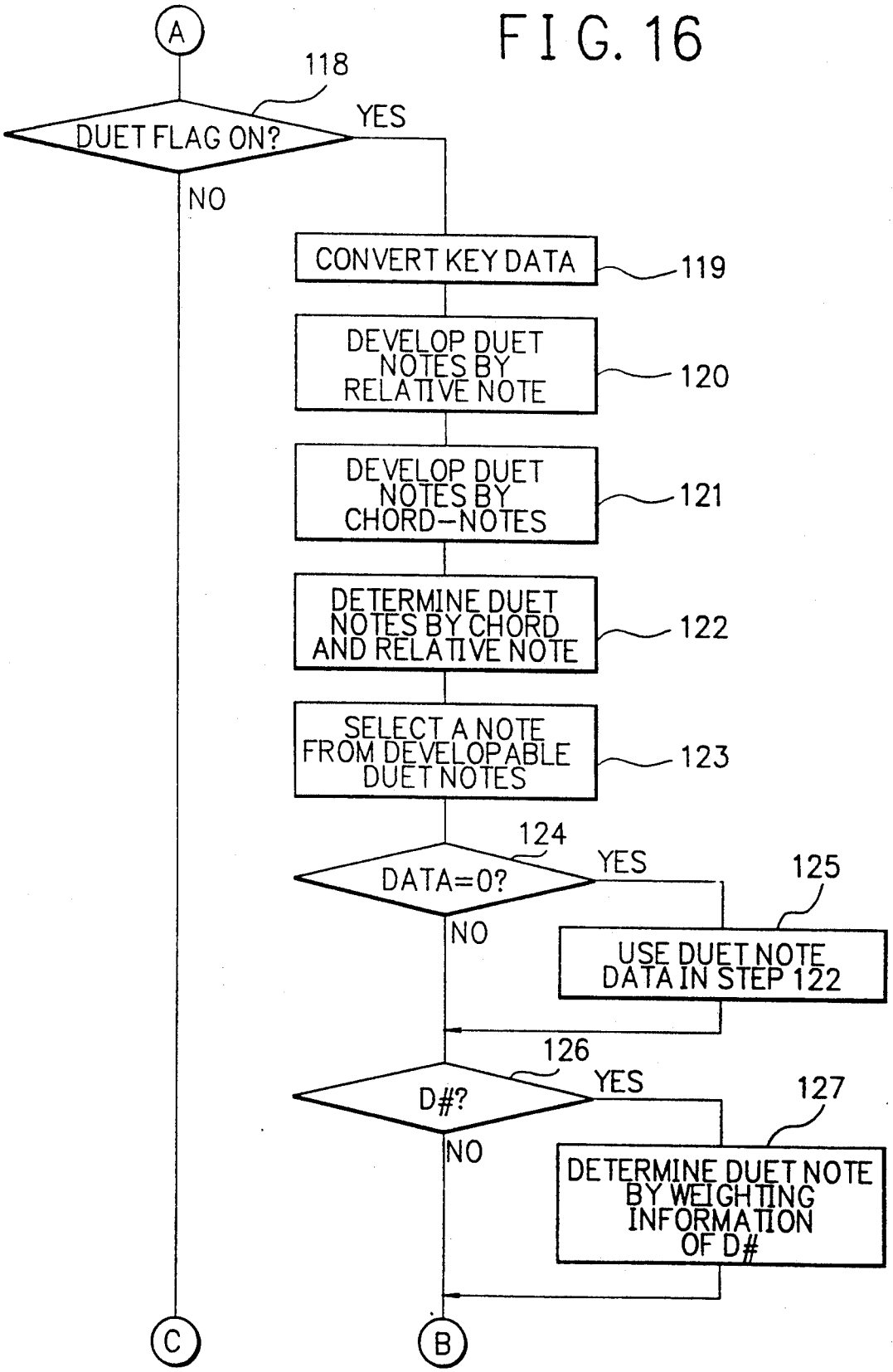
Figure 17:
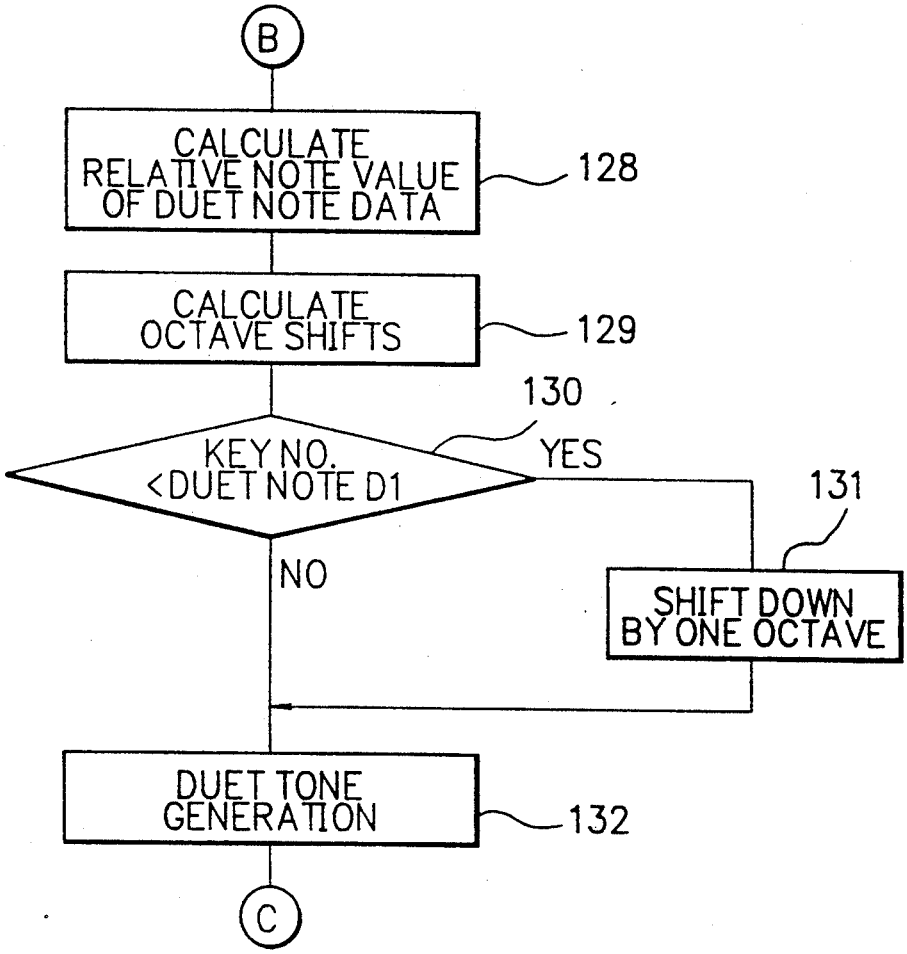
Figure 18:
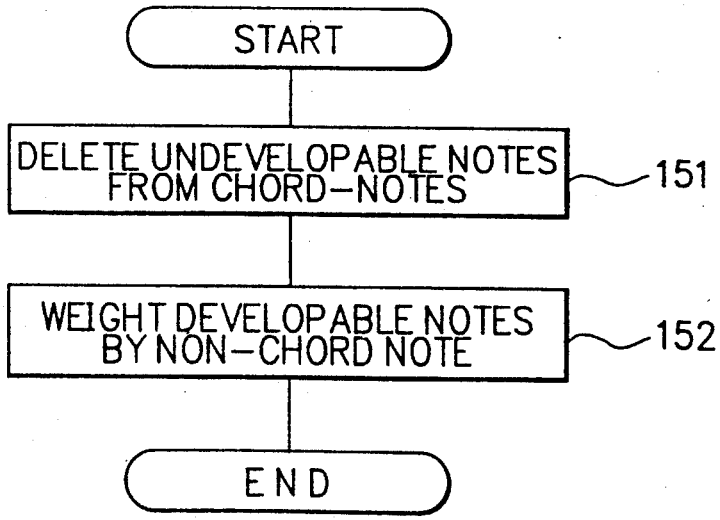

FIG. shows chord-notes information stored in a memory of the electronic musical instrument according to the present invention;

FIG. 4 shows an undevelopable note delete table stored in the memory of the electronic musical instrument according to the present invention;

FIG. 5 shows a non-chord note developable table stored in the memory of the electronic musical instrument according to the present invention;

FIG. 6 shows chord-notes weighting information stored in the memory of the electronic musical instrument according to the present invention;

FIG. 7 shows weighting information of note "D#" stored in the memory of the electronic musical instrument according to the present invention;

FIG. 8 shows a note developable weighting table stored in the memory of the electronic musical instrument according to the present invention;

FIG. 9 shows a one-note selection weighting table stored in the memory of the electronic musical instrument according to the present invention;

FIG. 10 shows a duet table for selecting a duet note calculated by the electronic musical instrument according to the present invention;

FIG. 11 shows the duet table for selecting a duet note calculated by the electronic musical instrument according to the present invention;

FIG. 12 shows the duet table for selecting a duet note calculated by the electronic musical instrument according to the present invention;

FIG. 13 shows the duet table for selecting a duet note calculated by the electronic musical instrument according to the present invention;

FIG. 14 shows a table showing duet notes calculated and selected by the electronic musical instrument according to the present invention;

FIG. 15 is a flow chart showing duet note selection executed by the electronic musical instrument according to the present invention;

FIG. 16 is a flow chart showing duet note selection executed by the electronic musical instrument according to the present invention;

FIG. 17 is a flow chart showing duet note selection executed by the electronic musical instrument according to the present invention; and FIG. 18 is a flow chart showing a chord-notes information setting operation executed by the electronic musical instrument according to the present invention.

DETAILED DESCRIPTION OF THE PREFERRED EMBODIMENTS

Figure 1:
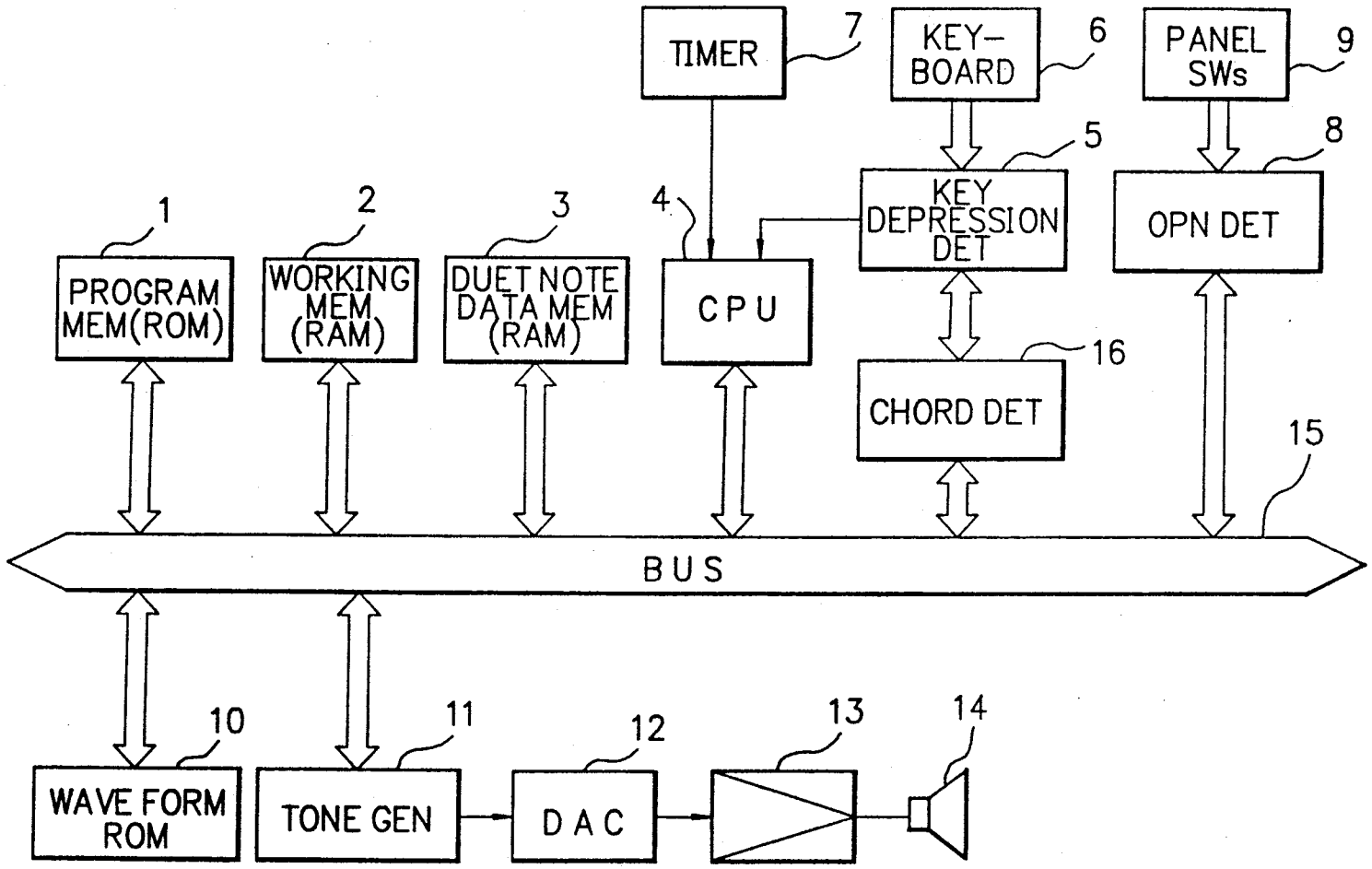
FIG. 1 is a block diagram of an electronic musical instrument according to an embodiment of the present invention.

An embodiment of an electronic musical instrument according to the present invention will be described in detail hereinafter with reference to the accompanying drawings. FIG. 1 is a block diagram showing the overall electronic musical instrument according to an embodiment of the present invention.

The electronic musical instrument of this embodiment comprises a microcomputer system. A program memory (ROM) 1 connected to a CPU 4 through a bus 15 stores a program for controlling the overall electronic musical instrument as well as processing for generating and adding a duet tone according to a detected chord and a detected melody tone. A working memory (RAM) 2 is used as a work area for storing data. A duet note data memory (RAM) 3 stores data for obtaining data of a duet note (ensemble note) to be added in the form of a table. The memory 3 preferably comprises a nonvolatile memory.

A key depression detection circuit 5 connected to key switches of a keyboard 6 forms an interrupt signal for informing generation of a key depression operation to the CPU 4 when the keyboard 6 is operated, and outputs pieces of information indicating a key depression speed and a key number according to a request from the CPU 4. A sensor for detecting the key depression speed is constituted by arranging two key switch contacts having different depths in a depression direction of a key. Note that the key depression detection circuit 5 similarly outputs an interrupt signal, key number information, and key release speed information when a key is released.

The output from the key depression detection circuit 5 is supplied to a chord detection circuit 16. The chord detection circuit 16 detects a played chord on the basis of key number information of depressed keys detected by the key depression detection circuit 5. For example, when keys depressed by an operator correspond to notes "C","E",and "G",the chord detection circuit 16 detects a C major chord; when depressed keys correspond to notes "C","E♭",and "G", it detects a C minor chord.

Panel switches 9 include switches for designating a tempo, a tone color (type of instrument), a beat, and the like, and a panel switch operation detection circuit 8 connected to these switches informs designated data to the CPU 4. Key scan operations of the keyboard 6 and the panel switches 9 are performed by interrupt processing executed at predetermined time intervals by a timer 7.

When the keyboard 6 is operated, the CPU 4 sends a tone control code consisting of pieces of information e.g., an interval, a tone volume, a tone duration, a tone generation time, and the like, to a tone generator 11 through the bus 15. The tone generator 11 reads out tone waveform data from a waveform ROM 10 at a pitch designated by the tone control code, processes an envelope, a sustain time, and the like of the readout data according to the tone control code, and outputs the processed data to a DAC (D/A converter) 12.

A tone output converted into an analog signal by the DAC 12 is supplied to a loudspeaker 14 through an amplifier 13, and a tone corresponding to a key operation is generated.

The CPU 4 detects a highest note (or lowest note) from the key numbers detected by the key depression detection circuit 5. The detected highest note (or lowest note) is used as a reference when a duet note is generated.

The principle of generation of a duet note (ensemble note) as the characteristic feature of the electronic musical instrument according to the present invention will now be described. FIG. 3 shows chord-notes information stored in the duet note data memory 3. FIG. 3 shows data indicating chord-notes based on a note "C" as a reference note, and shows 16 different chords. For example, in the case of chord "C" (C major, primary triads), since the chord is constituted by three notes "C","E",and "G",data "1" "0" is assigned to other notes, as shown in FIG. 3. is assigned to three notes "C","E",and "G",and data Similarly, in the case of chord "Cm",since the chord is constituted by three notes "C","E♭",and "G",data "1" is assigned to three notes "C","E♭",and "G",and data "0" is assigned to other notes, as shown in FIG. 3. The same applies to other chords. That is, data "1" is assigned to notes constituting a chord, and data "0" is assigned to other notes. Such chord constituting numerical value information is set in advance for chords having reference notes other than the note "C",and is stored in the duet note data memory 3.

FIG. 4 shows an undevelopable note delete table stored in the duet note data memory 3 as chord-notes weighting information. In this table, notes which can be added as duet note are indicated by data "1",and notes which cannot be added are indicated by data "0" in units of chords. Therefore, of chord-notes indicated by data "1" in FIG. 3, notes which cannot be added as duet notes, are indicated by data "0" in FIG. 4. In the case of FIG. 4, note "B" in chord "Cmaj7",note "E♭" in chord "Cdim",note "A" in chords "C6","Cm6",and "C13",and note "D" in chord "Cmadd9" correspond to notes which cannot be added as duet notes.

FIG. 5 shows an non-chord note developable table stored in the duet note data memory 3 as chord-notes weighting information. In this table, in addition to the chord-notes shown in FIG. 3, notes which can be added as duet note are indicated by data "2",and notes which cannot be added as duet notes are indicated by data "0". Therefore, data "2" in FIG. 5 indicate notes which can be added as duet notes, in the same manner as data "1" in FIGS. 3 and 4.

FIG. 6 shows data obtained by logical operation of the data in the chord-notes information shown in FIG. 3, the undevelopable note delete table shown in FIG. 4, and the non-chord note developable table shown in FIG. 5. More specifically, the data shown in FIG. 6 are obtained by deleting undevelopable note data "0" shown in FIG. 4 from chord-notes data "1" shown in FIG. 3, and adding developable note data of non-chord notes shown in FIG. 5. These data indicate notes to be added as duet notes in units of chords. FIG. 6 illustrates data "1" in FIG. 3 as "1",and data "2" in FIG. 5 as "2" as they are. The data calculation is performed by the CPU 4 on the working memory 2.

FIG. 8 shows a note developable weighting table stored in the duet note data memory 3. This table presents data of notes which can be added as duet notes according to relative notes (to be described later). FIG. 8 shows notes which can be added as duet notes according to melody tones in the case of a chord based on a note "C" as a reference note. For example, when a melody tone corresponding to a depressed key has note "C",since data "1" is assigned to notes "E♭","E", "G",and "A" in the row of "C" of data in the weighting table shown in FIG. 8, these notes can be added as duet notes. Similarly, when a melody tone corresponding to a depressed key has note "C♯",since data "1" is assigned to notes "E", "F♯", "G", and "A" in the row of "C♯" of data in the weighting table, these notes can be added as duet notes.

FIG. 9 shows a weighting table for selecting one note from the data shown in FIG. 8, as will be described later. This table is stored in the duet note data memory 3, and is used for selecting one of obtained duet notes when a duet note to be added is obtained by calculating the weighting numerical value information shown in FIG. 6 and information stored in the weighting table shown in FIG. 8, as will be described later. The table shown in FIG. 9 also presents notes of tones which can be added as duet notes according to melody tones in the case of a chord based on note "C" as a reference note like in the table shown in FIG. 8. For example, when a melody tone corresponding to a depressed key has note "C",since data "1" is assigned to notes "E♭" and "E" in the row of "C" of data in the weighting table shown in FIG. 9, these notes can be added as duet notes. Since the number of notes which can be added is smaller than the number of notes, i.e., notes "E♭","E","G",and "A" assigned with data "1" in the same row of "C" in the table of FIG. 8, the number of duet notes obtained using the table shown in FIG. 8 can be further decreased.

FIGS. 10 to 13 show a calculation table for calculating duet notes, which can be added, on the basis of data shown in FIGS. 6, 8, and 9. In the first row of the table shown in FIGS. 10 to 13, pieces of chord-notes weighting information shown in FIG. 6 are provided for 16 different chords based on note "C" as a reference note. In the second to lowermost rows, note developable weighting tables shown in FIGS. 8 and 9 are provided for the 16 different chords. More specifically, the note developable weighting tables obtained by calculating logical sums in FIGS. 8 and 9 are provided below the pieces of chord-notes weighting information for the 16 different chords. In these note developable weighting tables, "2" is assigned to data, which are determined to be able to be added in both the tables in FIGS. 8 and 9, and "1" is assigned to data, which are determined to be able to be added in only the table in FIG. 8. For example, in the row of note "C", since data "1" is assigned to notes "E♭","E","G",and "A" in the table in FIG. 8, and data "1" is assigned to notes "E♭" and "E" in the table in FIG. 9, data "2" is assigned to the notes "E♭" and "E" common to the two tables, and data "1" is assigned to the notes "G" and "A" which are "1" in only the table in FIG. 8.

For example, in the leftmost column in FIG. 10, chord-notes weighting information of chord "C" is assigned to the first row. With this information, in chord "C",notes "C","D","E",and "G" can be added as duet notes. When a melody tone corresponding to a depressed key has note "C", since data "1" or "2" is assigned to notes "E♭","E","G",and "A" in the row of "C" of data in the weighting table shown in FIG. 8, these notes can be added as duet notes. Therefore, of the notes "C","D","E",and "G" obtained from the chord-notes weighting information in the first row, and the notes "E♭","E","G",and "A" corresponding to data "1" or "2" in the row of "C" of the weighting table, the common notes "E" and "G" are selected as duet notes which can be added. Of these selected notes "E" and "G",data "2" is assigned to the note "E",and data "1" is assigned to the note "G" in the row of "C". Therefore, when one of these two notes is to be selected, the note "E" assigned with data "2" is selected. More specifically, the note "E" assigned with data "1" in the one-note selection weighting table shown in FIG. 9 is selected, and the note "G" assigned with data "0" is not selected.

Similarly, when, for example, a chord "C" is detected, and a melody tone corresponding to a depressed key has note "C♯",of notes "C","D","E", "G",and "C♯" assigned with data "1" or "2" in the chord-notes weighting information in the first row, and notes "E","F♯","G",and "A" assigned with data "1" or "2" in the row of "C♯" in the weighting table, common notes "E" and "G" are selected as duet notes which can be added. Of these selected notes "E" and "G",data "1" is assigned to the note "E",and data "2" is assigned to the note "G" in the row of "C♯". Therefore, when one of these two notes is to be selected, the note "G" assigned with data "2" is selected. More specifically, the note "G" assigned with data "1" in the one-note selection weighting table shown in FIG. 9 is selected, and the note "E" assigned with data "0" is not selected.

In this manner, a common note is selected using the chord-notes weighting information shown in FIG. 6, and the note developable weighting tables shown in FIGS. 8 and 9, thereby obtaining a duet note to be added. Such a calculation is performed by the CPU 4 on the working memory 2.

FIG. 7 shows weighting numerical value information of note "D#" stored in the duet note data memory 3. When a melody tone (highest tone) corresponding to a depressed key has note "D#",the number of tones to be added as duet notes is limited unlike in a case wherein another tone corresponds to a depressed key. More specifically, when a tone corresponding to the note "D#" is generated, and when a duet note obtained based on the chord-notes weighting information and the note developable weighting tables is added to the note "D#", an improper tone is often added. As for the note "D#", the duet notes obtained as described above include tones felt as dissonances when a player listens to them. Therefore, when a melody tone corresponding to a depressed key has the note "D#",duet note data obtained by a calculation shown in FIGS. 10 to 13 is logically ANDed with data shown in FIG. 7, and only common data is determined as a duet note to be added. For example, as shown in FIG. 10, when a detected chord is a chord "C",and a melody tone corresponding to a depressed key has note "D#",notes "C" and "G" are obtained as duet notes to be added. Of these notes, since only the note "G" is assigned with data "1" in the row of the chord "C" of the weighting numerical value data shown in FIG. 7, the note "G" is selected as a duet note to be added.

FIG. 14 shows duet notes finally obtained as described above. As shown in FIG. 14, when, for example, a detected chord is chord "C",and a melody tone corresponding to a depressed key has note "C", note "E" is finally selected as a duet note to be added. When a detected chord is chord "C",and a melody tone corresponding to a depressed key has note "C#",note "G" is finally selected as a duet note to be added.

Similarly, when another chord is detected, and another melody tone corresponds to a depressed key, a duet note to be added can be obtained by a calculation using the table shown in FIGS. 10 to 13.

Figure 2:
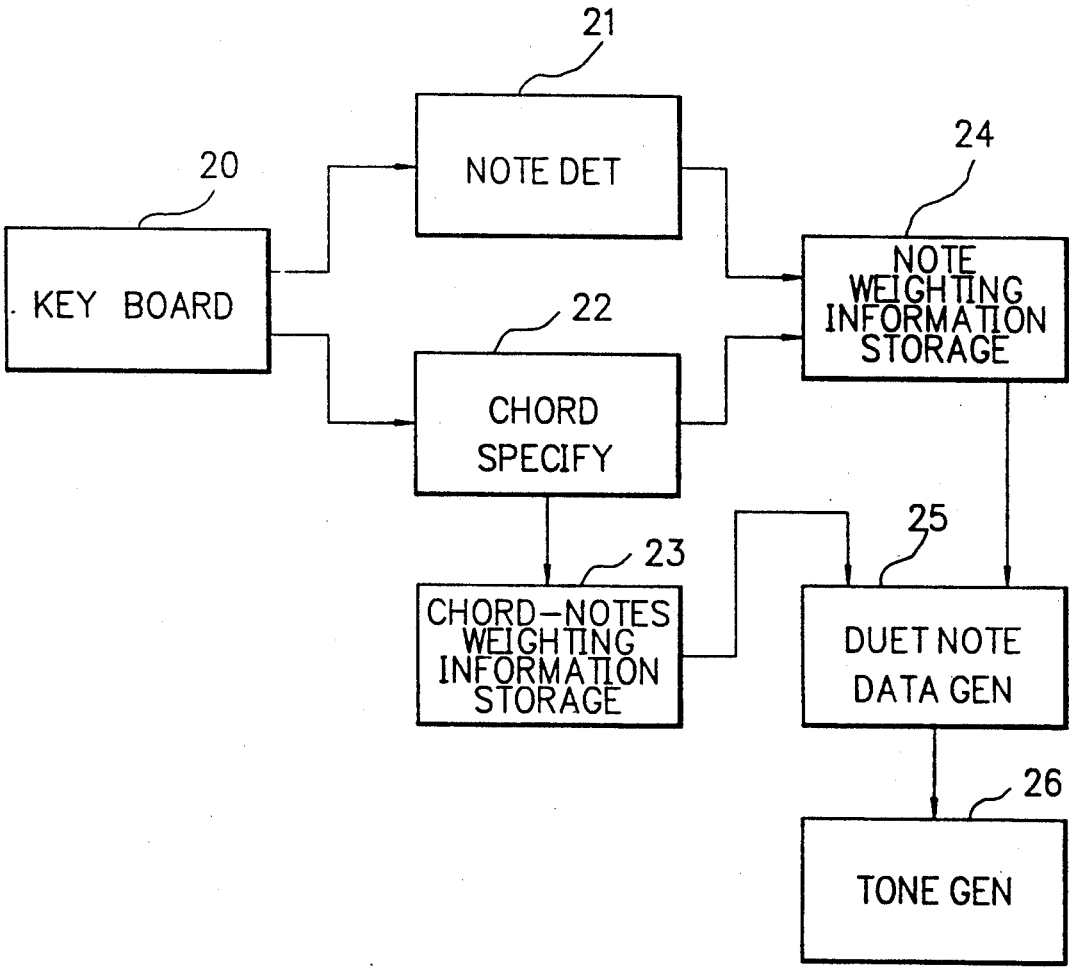
FIG. 2 is a functional block diagram showing elemental features of the present invention.

FIG. 2 is a block diagram showing the elemental features of the present invention. When addition of a duet note (ensemble note) is instructed, data of a tone, which is based on chord-notes and can be added as a duet note, is read out from a chord-notes weighting information storage means 23 comprising the duet tone data memory 3 according to a chord specified by a chord specifying means 22 comprising the chord detection circuit 16. In addition, data of a note, which can be added as a duet note, is read out from a note weighting information storage means 24 comprising the memory 3 on the basis of the chord specified by the chord specifying means 22 and a note detected by a note detection means 21 comprising the key depression detection circuit 5. A duet note data generation means 25 comprising the CPU 4 calculates these readout data to obtain data of a duet note to be added. A tone corresponding to the duet note data generated by the duet note data generation means 25, and a tone played at a keyboard 20 are produced from a tone generator means comprising the tone generator 11, the DAC 12, the amplifier 13, and the loudspeaker 14.

FIGS. 15 to 17 are flow charts showing the operations of the CPU 4 of the electronic musical instrument of this embodiment. In this flow, processing for obtaining a duet note to be added on the basis of a chord and a melody note (highest note), which are detected upon key depressions, is mainly performed. In step 101, the overall electronic musical instrument is initialized, and in step 102, key scan processing of all the keys is performed. In step 103, it is checked if a key event is detected. If YES in step 103, it is checked in step 104 if the detected key event is an OFF event (key release operation). If NO in step 103, the flow advances to step 111 to execute panel scan processing.

If YES in step 104, search processing of a corresponding channel in which tone generation is to be stopped is performed in step 105, and tone generation stop processing is performed in step 106. More specifically, a tone generation channel to which a key number of a released key is assigned is searched, and tone generation stop processing of the searched channel is performed. After the tone generation stop processing, highest note detection processing is performed in step 110, and the highest note of tones corresponding to ON or OFF events detected by the key depression detection circuit 5 is detected. A duet note is added to the detected highest note.

If it is determined in step 104 that the detected key event is not an OFF event, i.e., that the event is an ON event (key depression operation), chord detection processing is performed in step 107. More specifically, a C major chord, C minor chord, or the like is detected on the basis of a key number of the depressed key. In step 108, search processing of a channel to be assigned is performed. More specifically, a corresponding key is assigned to one of a plurality of tone generation channels of the tone generator 11. Thereafter, tone generation processing is performed in step 109, and the flow then advances to step 110 to execute the highest note detection processing.

In the panel scan processing in step 111, detection scan operations of all the operation members (buttons) on the operation panel are performed by the panel switch operation detection circuit 8. It is checked in step 112 if an ON event (ON operation) is detected. If YES in step 112, it is checked in step 113 if the detected ON event is a duet event. If YES in step 113, it is checked in step 114 if the duet event is a duet ON (duet tone addition processing) event. If YES in step 114, a duet flag is set in step 115; otherwise, the duet flag is cleared in step 116. If NO in step 113, other panel processing is performed in step 117.

It is checked in step 118 if the duet flag is ON (duet note addition processing). If YES in step 118, key information conversion is performed in step 119. The key information conversion is processing for converting key number data "0" to "127" of depressed keys in a melody play operation into relative note data "0" to "11". More specifically, 128 key number data are converted into 12 semitone data (relative note data) included within a range between note "C" and note "B" in units of octaves, which range includes root notes of detected chords as reference notes. In this conversion, the difference between key number data of a depressed key and key number data of a root note of a chord is obtained, and when the obtained difference data exceeds 12, a multiple of 12 is subtracted from the difference data to obtain data equal to or lower than 12. Therefore, the converted data includes only information indicating a note within a range of 12 semitones between note "C" and note "B",and does not include octave information.

In step 120, data which can be added as a duet note is fetched from the note developable weighting table shown in FIG. 8 on the basis of the relative note data obtained in step 119. For example, when the root note of the detected chord is note "C",if the relative note data of the melody tone is "0",since key depression data has a difference "0" from the note "C", i.e., is note "C",data corresponding to the note "C" in FIG. 8 are developed In this case, notes which can be added as a duet note are notes "E♭","E","G",and "A". On the other hand, if the relative note data is "4", data corresponding to note "E" in FIG. 8 are fetched, and a note which can be added as a duet note, is note "C".

In step 121, data which can be added as a duet note, is fetched from the chord-notes weighting information shown in FIG. 6 on the basis of the detected chord. For example, when the detected chord is chord "C", it can be determined based on data corresponding chord "C" in FIG. 6 that notes which can be added as duet notes have notes "C","D","E",and "G".

FIG. 18 shows the flow for obtaining the chord-notes weighting information shown in FIG. 6. As shown in FIG. 18, undevelopable notes are deleted from the chord constituting note numerical value information in step 151. More specifically, data of the chord-notes information shown in FIG. 3, and data of undevelopable notes shown in FIG. 4 are logically ANDed, thereby deleting undevelopable notes from the chord-notes information. In step 152, the calculation value is weighted with developable information other than the chord-notes. More specifically, the result obtained in step 151 is logically ORed with data in the non-chord note developable table shown in FIG. 5, thereby weighting developable numerical value information other than the chord-notes. These calculations are performed by the CPU 4 and the working memory 2.

Referring back to FIG. 16, in step 122, the chord-notes weighting information shown in FIG. 6 and the note developable weighting table shown in FIG. 8 are logically ANDed. More specifically, notes which can be added as duet notes are obtained on the basis of the detected chord and the relative note data. For example, when the detected chord is chord "C",and the relative note data is "0",data of chord "C" in the first row of the duet table shown in FIG. 10, and data of note "C" in the second row of the leftmost column are used. As shown in FIG. 10, notes which can be added as duet notes in data of chord "C" are notes C, D, E, and G, and notes which can be added as duet notes in data of depressed key C are notes "E♭","E","G", and "A". Therefore, as shown in FIG. 10, when these data are logically ANDed, common notes "E" and "G" are determined as duet notes which can be added.

In step 123, the data obtained in step 122 and the one-note selection weighting table shown in FIG. 9 are logically ANDed. For example, when the detected chord is chord "C",and the relative note data is "0", and when notes "E" and "G" are obtained as duet notes which can be added, the table shown in FIG. 9 presents only notes "E♭" and "E" as duet notes which can be added in correspondence with the note "C". Therefore, when the logical product of these data is calculated, since only the note "E" remains as a duet note which can be added, only the note "E" is selected as the duet note which can be added, in this case. In this manner, when a plurality of notes remain as duet notes which can be added, in data obtained by the duet table shown in FIG. 10, one of the obtained notes is selected by calculating the logical product with the one-note selection weighting table shown in FIG. 9. In step 124, it is checked if the data obtained by calculating the logical product with the one-note selection weighting table shown in FIG. 9 is "0". If YES in step 124, i.e., if it is determined that no duet note remains as a result of calculation of the logical product in step 123, data obtained by the duet table shown in FIGS. 10 to 13 is used as duet note data in step 125. If NO in step 124, the flow advances to step 126.

In step 126, it is checked if the detected relative note data, i.e., the key depression data of the highest note detected by the key depression detection circuit corresponds to note "D♯". If YES in step 126, data obtained in step 123 or step 125 and the weighting information shown in FIG. 7 are logically ANDed in step 127. This is because the number of tones to be added as duet notes is limited when the key depression data corresponds to note "D♯", as described above.

In step 128, a relative note of the duet note data obtained in step 123, 125, or 127 is formed. More specifically, the number of semitones between the obtained duet note data and the highest note detected in step 110 is calculated. In this case, since the highest note is converted into data including only a note name while ignoring octave data, the relative note of the duet note data from the highest note falls within a range between 0 and 12 as the number of semitones. In step 129, a calculation is made using the obtained relative note of the duet note data, and octave data. More specifically, the number of octaves corresponding to an interval between the duet note data and the highest note data is added to or subtracted from the duet note data represented by the relative note with respect to the highest note data, thereby obtaining an actual interval between a duet note to be added and the highest note. This processing is attained by the following equation:

$$(\textit{Relative Note}) + 12 \times (\textit{Number of Octaves})$$

In step 130, it is checked if the obtained duet note D1 to be added corresponds to a note higher than key information. More specifically, it is checked whether or not the duet note D1 to be added corresponds to a note higher than the highest note. Since the duet note D1 must correspond to a tone lower than the highest note so as to emphasize the highest note as a melody tone, if it is determined that the duet note D1 to be added corresponds to a note higher than the highest note, the flow advances to step 131, the number of notes "12" is subtracted from the duet note data to convert the data into data of a note lower by one octave. Thereafter, duet tone generation processing is performed in step 132. If it is determined that the duet note D1 to be added does not correspond to a note higher than the highest note, since the duet note need not be changed, the flow advances to step 132 without going through step 131, thus performing duet tone generation processing. In this manner, a tone corresponding to the selected duet note is generated together with the melody tone. After the duet tone generation processing, the flow returns to step 102 to execute key scan processing again.

As described above, data of a duet note to be added is obtained. According to the apparatus of this embodiment, as described above, chord-notes weighting data representing duet notes, which can be added, in units of types of chords, and the note developable weighting table representing data of duet notes, which can be added, in units of relative notes of melody tones (highest or lowest note), are stored in advance in the duet note data memory 3. Duet note data which can be added are obtained from the chord-notes weighting information according to the detected chord, while duet note data which can be added are obtained from the note developable weighting table according to the relative note of the detected highest note. A logical product of these data is calculated to obtain duet note data which can be added. Therefore, the chord-notes weighting information and the note developable weighting table need only be stored in the duet note memory 3, and duet note data which can be added can be obtained from these data.

In the description of the above embodiment, a duet note to be added to the highest note of melody tones is obtained. The lowest note in played melody tones may be detected, and a duet note may be added to the detected lowest note. The chord-notes weighting data, and the note developable weighting table data may consist of data representing an interval difference from the root of a chord.

In the conventional apparatus, as disclosed in U.S. Pat. No. 4,429,606, duet note difference data according to relative note data are stored in a memory in units of chords, and duet note difference data is read out according to the detected chord and highest tone, thereby obtaining a duet tone to be added. Therefore, data corresponding in number to the product of the number of types of chords and the number (12) of relative note data must be stored, and a large memory capacity is required. In contrast to this, according to the apparatus of this embodiment, two types of data, i.e., the chord-notes weighting numerical value information shown in FIG. 6, and the note developable weighting table shown in FIG. 8, need only be stored in the duet data memory 3. For this reason, data corresponding in number to the sum of the number of types of chords and the number (12) of relative note data need only be stored, and the capacity of the memory for storing duet tone data can be reduced.

When a plurality of duet note data are obtained based on the chord-notes weighting numerical value information shown in FIG. 6, and the note developable weighting table shown in FIG. 8, since one duet note can be obtained by calculating the logical product with data in the one-note selection weighting table shown in FIG. 9, a problem that a plurality of selected duet note data remain can be solved.

Furthermore, when a tone corresponding to a depressed key has note "D#",a logical product of the duet note data obtained as described above and weighting numerical value information of D# shown in FIG. 7 is calculated, thereby eliminating an improper duet note inherent to a case wherein the tone corresponding to a depressed key has note "D#".

As described above, according to the present invention, two types of data, i.e., the chord-notes weighting numerical value information and the note developable weighting table, need only be stored, and duet note data to be added is formed by calculating these data. Therefore, data corresponding in number to the sum of the number of types of chords and the number (12) of relative note data need only be stored, and the capacity of the memory for storing duet note data can be reduced.

What is claimed is:

1. An electronic musical instrument comprising:

a keyboard apparatus;

chord specifying means for specifying a chord on the basis of a key play operation at said keyboard apparatus;

note detection means for detecting a note, to which a duet note is to be added, on the basis of key depression information obtained from said keyboard apparatus;

chord-notes weighting information storage means for storing first potential duet notes, said first potential duet notes being weighted according to chord-notes and the chord type;

note weighting information storage means for storing second potential duet notes, said second potential duet notes being weighted according to relative notes of a root note of the chord-notes and the chord type;

duet note data generation means for reading out said first and second potential duet notes in response to the chord specified by said chord specifying means and the note detected by said note detection means, and determining a duet note on the basis of the readout data; and tone generation means for generating a duet tone corresponding to the duet note determined by said duet note data generation means, and a melody tone played at said keyboard apparatus.

2. The instrument of claim 1, wherein said duet note data generation means logically ANDs said first potential duet notes with said second potential duet notes to determine said duet note.

3. The instrument of claim 2, wherein said duet note data generation means further logically ANDs a result of the first logical AND with one-note selection weighting information in order to determine a unique duet note.

4. The instrument of claim 1, wherein said first potential duet notes are determined by deleting first duet notes which constitute a chord which may not be added as said duet note, and further adding other first duet notes which do not constitute a chord and may be added as said duet note.

5. The instrument of claim 1, wherein when the note detected by said note detection means is a "D sharp" note, said duet note data generation means reads out third potential duet notes, which may be added as said duet note, from said chord-notes weighting information storage means.

6. The instrument of claim 1, wherein the note to which said duet note is to be added, and which is detected by said note detection means is one of highest and lowest note of tones corresponding to depressed keys.

7. The instrument of claim 1, wherein said first and second potential duet notes are stored as an interval difference from a root note of the chord.

8. An electronic musical instrument comprising:

a keyboard apparatus;

chord specifying means for specifying a chord type on the basis of a key play operation at said keyboard apparatus;

note detection means for detecting a play note, to which a duet note is to be added, on the basis of key depression information obtained from said keyboard apparatus;

first octave-pattern data storage means for storing first octave-pattern data, responsive to the chord type specified by said chord specifying means, said first octave-pattern data including first potential duet notes to be added to the play note and weighted to chord-notes in octave notes for each chord type;

second octave-pattern data storage means for storing second octave-pattern data, responsive to the play note detected by said note detection means and the chord type specified data, said second octave-pattern data indicating second potential duet notes to be added to the play note, and weighted to octave notes in units of relative notes, each related to a root note of each chord type;

duet note data generation means for reading out said first and second octave-pattern data stored in said first and second octave-pattern storage means in response to the chord type specified by said chord specifying means and the play note detected by said note detection means, and determining duet note data based on the read data; and tone generation means for generating a tone corresponding to the duet note determined by said duet note data generation means, and a the play note played at said keyboard apparatus.

9. The instrument of claim 8, wherein said duet note data generation means comprises logical means for logically ANDing said first and second octave-pattern data read from said first and second octave-pattern data storage means in units of octave notes to generate said duet note data to be added to the play note.

10. The instrument of claim 9, wherein said second octave-pattern data storage means further includes third octave-pattern data, including fewer duet notes than said second octave-pattern data said first, second and third octave-pattern data, for selecting a single duet note among potential duet notes.

11. The instrument of claim 9, wherein said second octave-pattern data storage means further includes as potential duet note data for a melody note, D sharp, and said duet note generation means further logically ANDs said first, second and fourth octave-pattern data when the melody note D sharp is detected by said note detection means.

12. The instrument of claim 8, wherein said first octave-pattern data includes duet note developed by deleting note data, which cannot be added as a duet note to the chord type specified by said chord specifying means, and note data which does not constitute a chord which can be added as the duet note.

13. The instrument of claim 8, wherein the note to which a duet note is to be added, and which is detected by said note detection means is one of highest and lowest notes of tones corresponding to depressed keys.

14. The instrument of claim 8, wherein data stored in said chord-notes weighting information storage means and said note weighting information storage means are stored as data of an interval difference from the root note of the chord.

15. An electronic musical instrument comprising:

chord note weighting information storing means for storing weighting information for each of a plurality of chords types;

note weighting information storing means for storing weighting information for each of a plurality of melody tones;

keyboard means for activating at least one of said plurality of chord types and at least one of said melody tones;

duet note generating means for generating duet note difference data from said weighting information for each of the plurality of chord types and said weighting information for each of the plurality of melody tones;

wherein said duet note difference data is a sum of said weighting information for each of the plurality of chord types and said weighting information for each of the plurality of melody tone; and tone operation means for generating an ensemble tone from said at least one of said plurality of chord types, said at least one of said melody tone, sand said duet note difference data.

16. The electronic musical instrument of claim 15, wherein said weighting information for each of the plurality of chord types is logically ANDed with said weighting information for each of the plurality of melody tones to produce said duet note difference data.

17. The electronic musical instrument of claim 16, further comprising, one-note selection weighting means, including a one-note selection weighing table, for selecting between a plurality of duet note difference data generated by said duet note generating means.

18. The electronic musical instrument of claim 17, wherein said one-note selection weighting means logical ANDs said one-note selecting weighting table and the plurality of duet note difference data to produce selected duet note difference data;

said tone generation means generating the ensemble tone from said selected duet note difference data.

19. The electronic musical instrument of claim 18, wherein said weighting information for each of the plurality of chord types is generated by logical ANDing chord note information received upon activation of at least one of said plurality of chord types by said keyboard means, with undevelopable note information, indicative of tones which are aurally incompatible with said at least one of said plurality of chord types, to procedure developable information, wherein said developable information is logically read with non-chord note developable information, indicative of a duet tone preference, to produce said weighting information for each of the plurality of chord types.

20. The electronic musical instrument of claim 15, further comprising D sharp detecting means for detecting if the at least one of said melody tones activated by said keyboard means is a D sharp tone.

21. The electronic musical instrument of claim 20, wherein said weighting information for each of the plurality of chord types is logically ANDed with said weighting information for each of the plurality of melody tones to produce said duet note difference data.

22. The electronic musical instrument of claim 21, further comprising D sharp weighting information storing means for storing D sharp weighting information which is logically ANDed with said duet note difference data to produce D sharp duet note difference data.

23. The electronic musical instrument of claim 22, further comprising:

one-note selection weighting means, including a one-note selection weighting table, for selecting between a plurality of duet note difference data generated by said duet note generating means.

24. The electronic musical instrument of claim 23, wherein said one-note selection weighting means logical ANDs said one-note selecting weighting table and the plurality of duet note difference data to produce selected duet note difference data;

said tone generation means generating the ensemble tone from said selected duet note difference data.

25. The electronic musical instrument of claim 24, wherein said weighting information for each of the plurality of chord types is generated by logical ANDing chord note information received upon activation of at least one of said plurality of chord types by said keyboard means, with undevelopable note information, indicative of tones which are aurally incompatible with said at least one of said plurality of chord types, to produce developable information, wherein said developable information is logically read with non-chord note developable information, indicative of a duet tone preference, to produce said weighting information for each of the plurality of chord types.

* * * * *